United States Patent [19]

Blomquist et al.

[11] Patent Number: 4,618,276

[45] Date of Patent: Oct. 21, 1986

[54] DOT MATRIX PRINT HEAD

[76] Inventors: James E. Blomquist; Robert H. Wilczewski, both of 1130 Major Ave., both of Riverton, Wyo. 82501

[21] Appl. No.: 679,928

[22] Filed: Dec. 10, 1984

Related U.S. Application Data

[60] Continuation-in-part of Ser. No. 616,792, Jun. 1, 1984, Pat. No. 4,587,724, which is a division of Ser. No. 499,208, May 31, 1983, abandoned, which is a division of Ser. No. 425,255, Sep. 28, 1982, Pat. No. 4,401,392, which is a continuation of Ser. No. 256,032, Apr. 21, 1981, abandoned, which is a division of Ser. No. 38,724, May 14, 1979, Pat. No. 4,279,518.

[51] Int. Cl.[4] ..... B41J 3/12

[52] U.S. Cl. ..... 400/124; 101/93.05; 29/445; 29/602 R

[58] Field of Search ..... 400/124; 101/93.05; 29/DIG. 19, 602 R, 445

[56] References Cited

U.S. PATENT DOCUMENTS

| | | | |
|---|---|---|---|
| 4,165,940 | 8/1979 | Cacciola | 400/124 |
| 4,222,674 | 9/1980 | Mori | 400/124 |
| 4,244,658 | 1/1981 | Mori | 400/124 |
| 4,260,270 | 4/1981 | Cavallari | 400/124 |
| 4,320,981 | 3/1982 | Harrison | 400/124 |

*Primary Examiner*—Paul T. Sewell

*Attorney, Agent, or Firm*—W. Scott Carson

[57] ABSTRACT

This invention involves methods and apparatus relating to the assembly and structure of a dot matrix print head. In the preferred embodiment, the tops of the bobbins, yoke members, and pole pieces are ground flush in a common plane. The common plane is then used as a reference to mount and assembly remaining elements of the print head including the clapper members and backstop for the clapper members. The clapper members are mounted for pivotal movement between first and second positions by a cover member and securing cap. For uniform operation, the pivotal axis are all in the common reference plane on respective bobbin members and the gaps of the clapper members are automatically set to the identical size by intermeshing fingers on the cover and cap members. Additionally, corresponding and abutting surfaces on the bobbins, cover member, and cap member act in concert by the operation of a single screw to properly align, assembly, and adjust the operating parts of the print head.

23 Claims, 32 Drawing Figures

Fig. 21
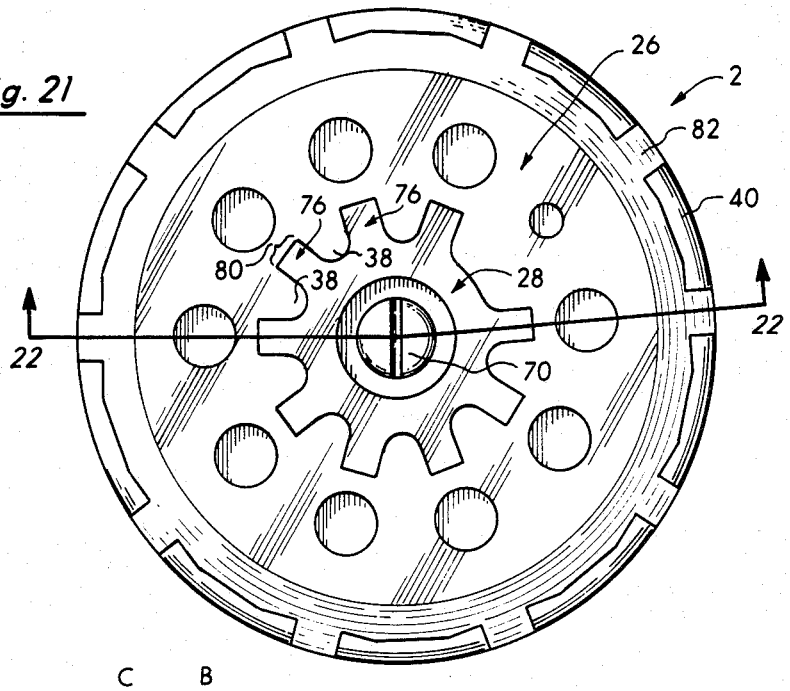
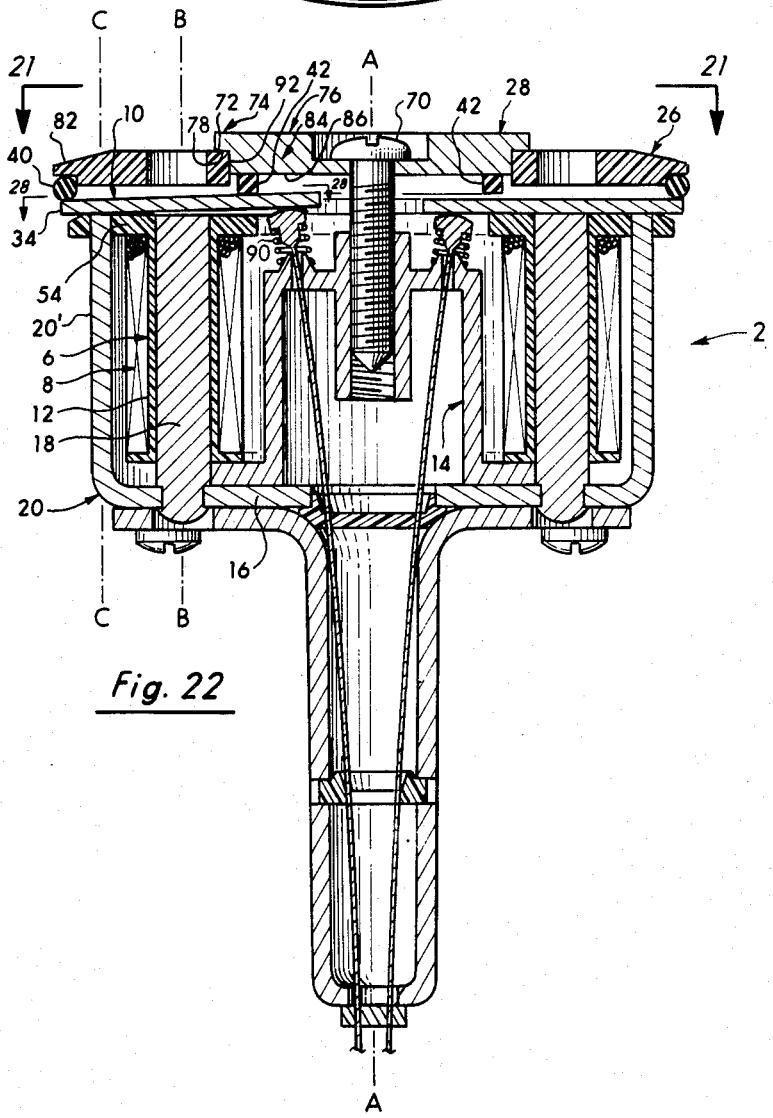
Fig. 22

Fig. 27
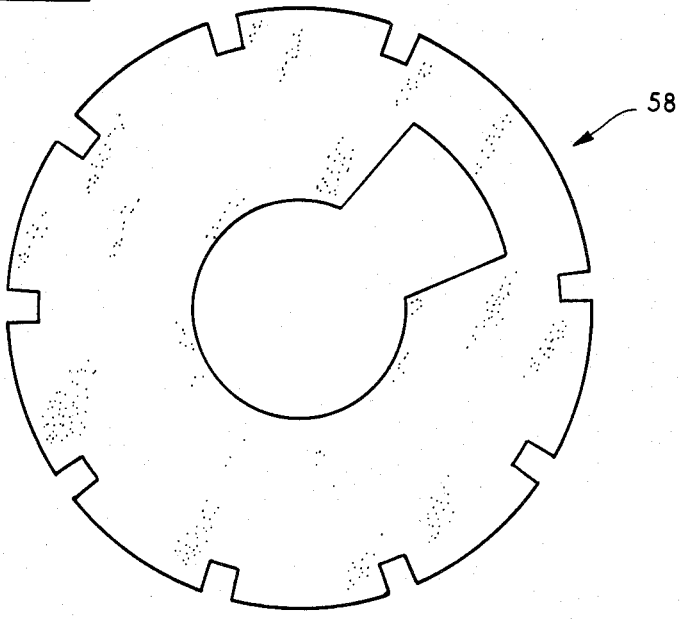
Fig. 28
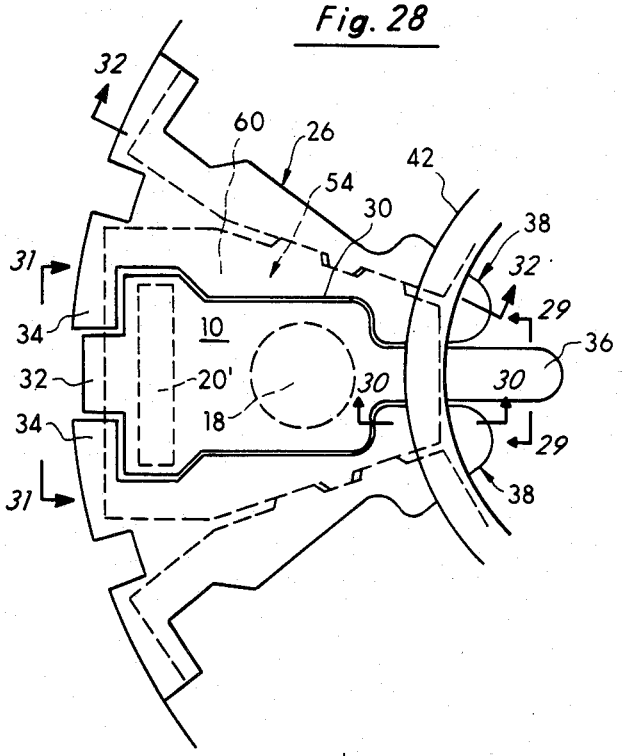
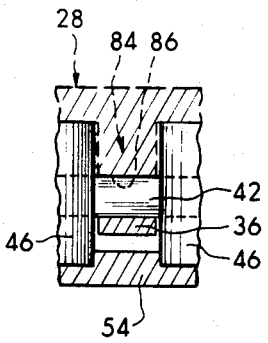
Fig. 29

DOT MATRIX PRINT HEAD

RELATED APPLICATIONS

This application is a continuation-in-part of U.S. patent application Ser. No. 616,792 filed June 1, 1984, now U.S. Pat. No. 4,587,724, which is a division of U.S. patent application Ser. No. 499,208, filed May 31, 1983 now abandoned, which is a division of U.S. patent application Ser. No. 425,255 filed Sept. 28, 1982, now U.S. Pat. No. 4,401,392, which is a continuation of U.S. patent application Ser. No. 256,032 filed April 21, 1981, now abandoned, which is a division of U.S. patent application Ser. No. 38,724 filed May 14, 1979, now U.S. Pat. No. 4,279,518.

FIELD OF THE INVENTION

This invention relates to the field of dot matrix printing and more particularly to the field of dot matrix print heads for printing alpha-numeric characters and symbols.

BACKGROUND OF THE INVENTION AND PRIOR ART

Much of the current activity in the dot matrix print head industry is being directed to improving the printing speed (characters per second, lines per minute) of the head to meet the needs of large company users. Such increased printing speed is usually accomplished with little thought being given to and at the expense of ease of manufacture, cost, reliability, ease of repair, degree of training needed to perform repairs, ruggedness, long life, and cost-performance ratios. Often, these current print head designs require the use of expensive and sophisticated materials and technology such as tungsten print wires, synthetic ruby bearings, and powdered metal technology with its expensive and scarce blends.

In direct contrast to the high speed printing needs of large company users are the needs of the rapidly developing personal computer market and small business computer market. In the personal and small business computer markets, the printing speed of the head is of relatively minor and of secondary importance in comparison to cost, reliability, ruggedness, long life, ease of repair, and the degree of training necessary to perform repairs. It was with these needs of the personal and small business computer markets in mind that the present invention was developed. In contrast to the expensive and somewhat exotic manufacturing technique used in making most of the current print heads (e.g., powdered metal technology, tungsten print wires), the present invention uses simpler stamping and screw machine technique, cheaper materials such as steel print wires, and greatly simplified manufacture and assembly procedures including the use of assembly aids for inserting the print wires into spaced-apart guide members, a grinding aid and method whereby all of the print wires can be more easily and quickly ground to the proper length, and unique coil assembly and mounting plate designs whereby the clappers or armatures are automatically aligned with the impact ends of the print wires during the assembly of the print head.

Illustrative of the state of the art in dot or wire matrix print heads are the following U.S. Pat. Nos.

3,333,667: Nordin
3,467,232: Paige 3,828,908: Schneider
3,842,955: Iwasaki
3,854,564: Flaceliere et al
3,889,793: Cattaneo
3,896,918: Schneider
3,897,865: Darwin et al
3,929,214: Hebert
3,991,869: Berrey
3,994,381: Hebert
4,004,671: Kondur, Jr.
4,004,673: Burzlaff et al
4,009,772: Glaser et al
4,049,107: Murat
4,049,108: Giessner
4,051,941: Hebert
4,060,161: Nelson et al
4,079,824: Ku
4,081,067: Schrag et al
4,091,909: Lee
4,117,435: Hishida et al
4,135,830: Hishida et al
4,140,406: Wolf et al
4,141,661: Geis et al None of these patents however, discloses the unique features of the present invention nor do any of these prior patents meet the needs and requirements of the developing personal and small business computer markets as well as the present invention.

SUMMARY OF THE INVENTION

This invention involves new and novel methods and apparatus relating to the assembly and structure of a dot matrix print head. The invention includes a unique coil assembly design comprising a bobbin, coil, and clapper built as a single unit that can be removably placed among fixed pole pieces and yoke members mounted about a guide wire assembly. In the coil assembly, the bobbin has a first portion with an open-ended, hollow shape dimensioned to slideably receive a pole piece. It also has second and third bobbin portions mounted to and extending outwardly in opposite directions from this first bobbin portion. The coil is mounted about the first bobbin portion and the clapper of the coil assembly is mounted between the second and third bobbin portion for movement relative to the bobbin. The clapper mounting means on the second and third bobbin portion positions the central axis of the clappers substantially perpendicular to the axis of symmetry of the first bobbin portion and also includes means for restraining the clapper from movement along the central axis relative to the bobbin. In a second embodiment, a unique return spring arrangement is provided between the second bobbin portion and one end of the clapper. The invention also includes a novel arrangement for supporting the coil assemblies in the print head whereby the clapper of each coil assembly is automatically aligned with the impact end of one of the print wires during the assembly of the print head. This supporting arrangement includes a mounting plate with free standing yoke portions and a plurality of pole pieces affixed to the mounting plate. The mounting plate, integral yoke portions, and pole pieces are all affixedly positioned relative to the wire guide assembly holding the print wires. Each second bobbin portion of each coil assembly also has an alignment slot dimensioned to slideably receive a respective yoke portion so that each coil assembly can be slid into place by receiving a pole piece in the first bobbin portion and a yoke portion in the alignment slot of the second bobbin portion. In this manner, the clapper of the respective coil assembly is automatically aligned with the impact end of one of the print wires during the assembly of the print head. This arrangement greatly simplifies the assembly process of the print head and significantly reduces the time required to assemble the print head for operation. Other novel structural features of the present invention include unique designs for a heat sink member, wire guide members, snap-in retaining means between the bobbin and pole pieces, and mounting structure by which the print head is attached to the main guide and rail guide bearings of the printing mechanism. The present invention also includes novel methods of assembling the components of the print head including the use of assembly aids for inserting the print wires into the wire guide members and a grinding technique whereby all of the print wires can be easily and quickly ground to the proper length. Structure and assembly techniques are also disclosed which grind the tops of the yoke members, pole pieces, and bobbin members flush with one another and use the plane of the flush tops as a reference to assembly and align various operating members of the print head.

BRIEF DESCRIPTION OF THE DRAWINGS

FIG. 21 is a top view of a modified print head design taken along line 21—21 of FIG. 22.

FIG. 22 is a cross-sectional view of the modified print head taken along line 22—22 of FIG. 21.

FIG. 27 is a top view of a thin, non-magnetic member that can be used as a spacer between the clapper members and pole pieces.

FIG. 28 is a view taken along line 28—28 of FIG. 22 showing the relationship of the pole pieces, inner O-ring, and the bobbin, yoke, clapper, and cover members.

FIG. 29 is a view taken along line 29—29 of FIG. 28 with additional members of the print head shown in dotted lines for clarity.

DETAILED DESCRIPTION OF THE PREFERRED EMBODIMENTS

Figure 1:
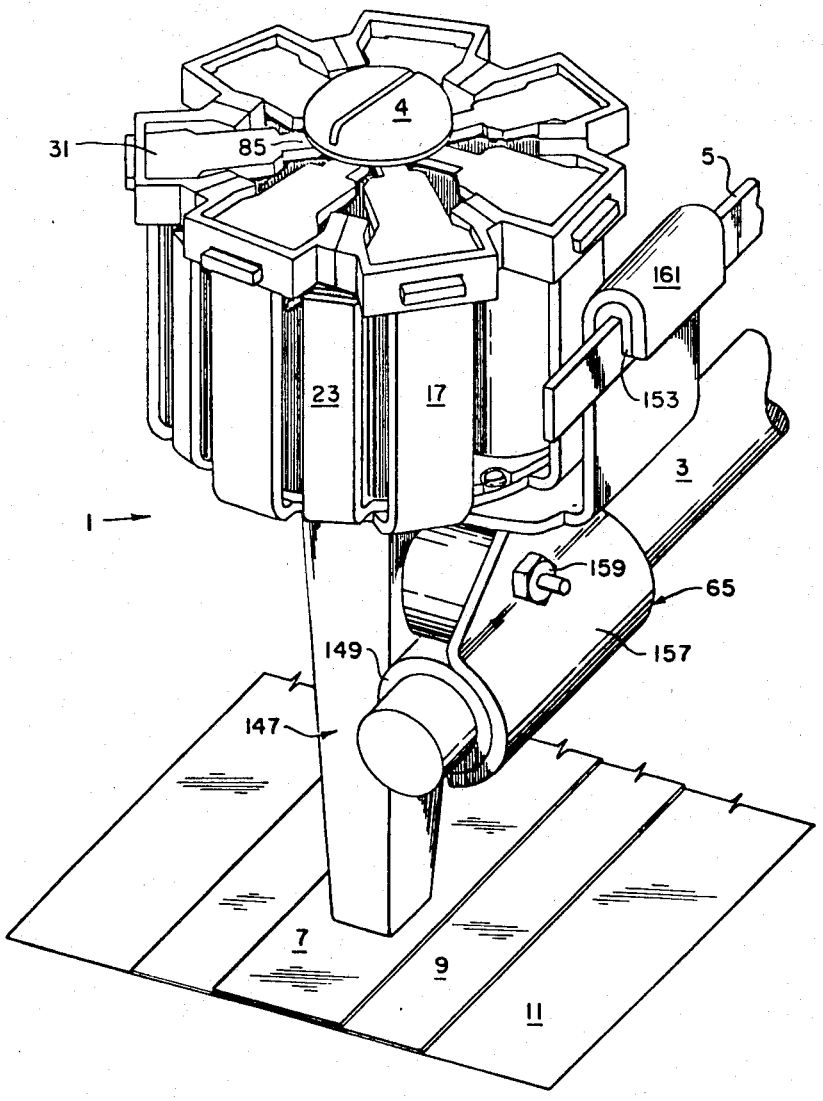
FIG. 1 is a perspective view of the print head of the present invention shown in use in one contemplated environment. For the sake of clarity, upstanding guide members 43 on the second portions of the bobbin members near the retaining screw 26 are not shown in this view.
Figure 2:
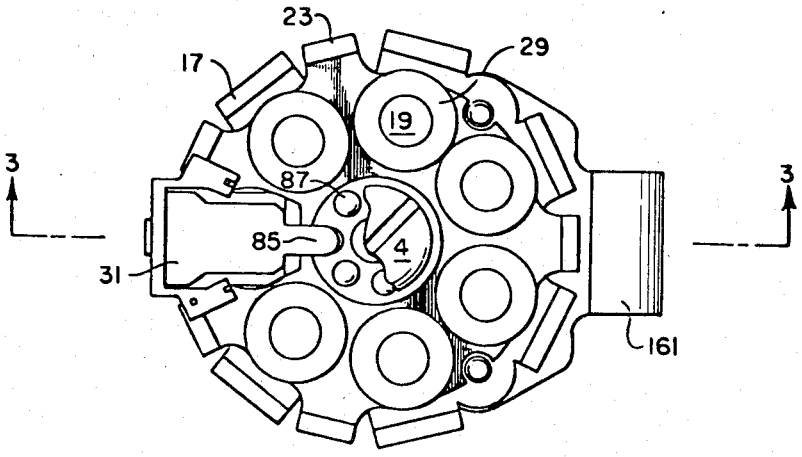
FIG. 2 is a top view of the print head of the present invention with some parts broken away and others not shown for the sake of clarity.

FIG. 1 is a perspective view of the print head of the present invention shown in use in one contemplated environment. In this view, the print head 1 is mounted for movement along head shaft 3 and rear guide rail 5 relative to the ribbon 7, paper 9, and platen 11. As best seen in FIGS. 1-4, the print head 1 of the present invention includes wire guide assembly 13, mounting plate 15 with upstanding yoke portion 17, pole pieces 19 fixedly secured to the mounting plate 15, heat sink member 21 with upstanding fingers 23, coil assemblies 25, and retaining screw 4 with resilient backstop 22.

Figure 3:
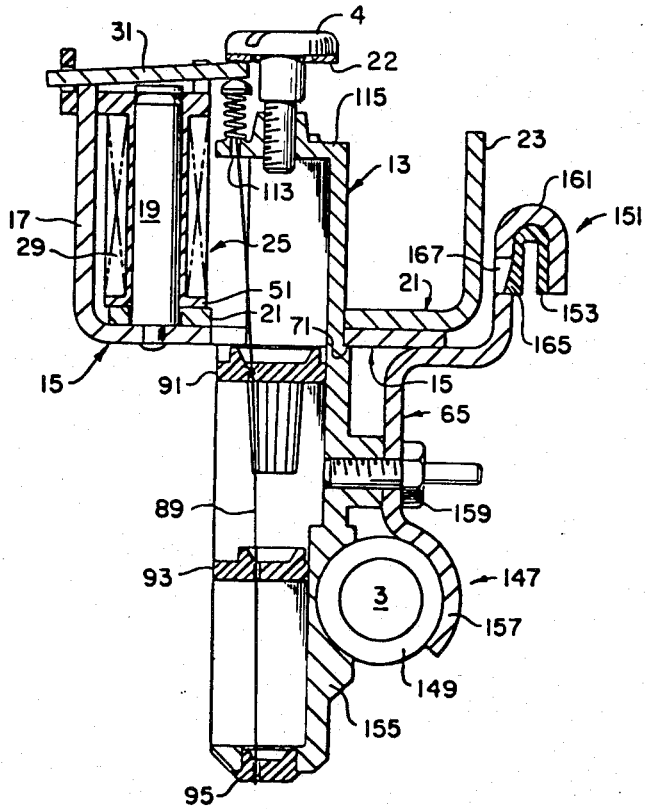
FIG. 3 is a cross-sectional view of the print head taken along line 3—3 of FIG. 2.
Figure 4:
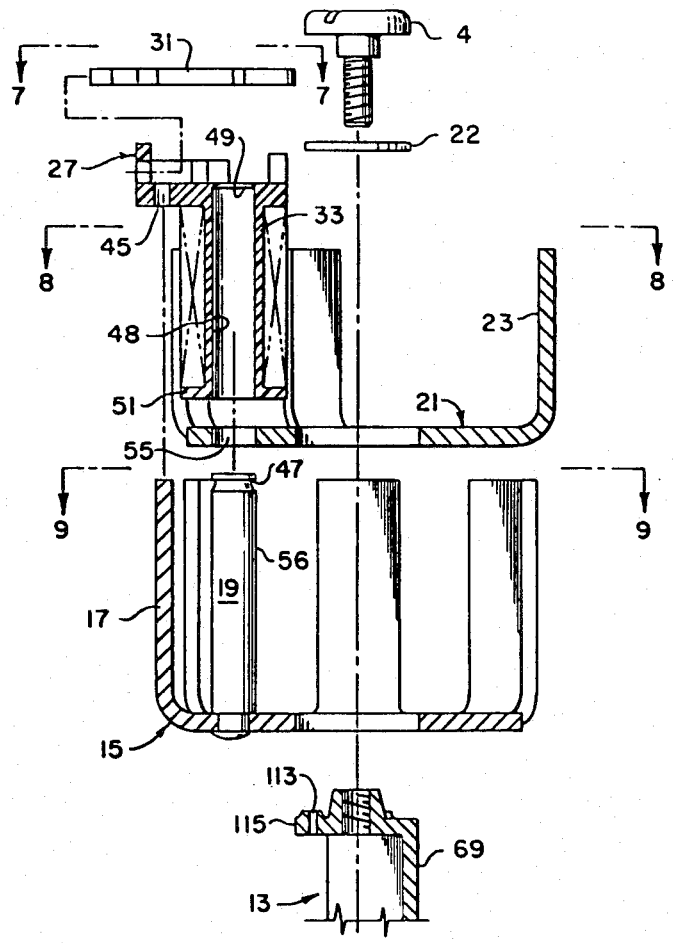
FIG. 4 is a partially exploded view of the top half of FIG. 3 showing the relationship between many of the major parts of the print head including the coil assembly, heat sink member, mounting plate with its integral yoke portions, pole pieces, and the wire guide assembly.
Figure 5:
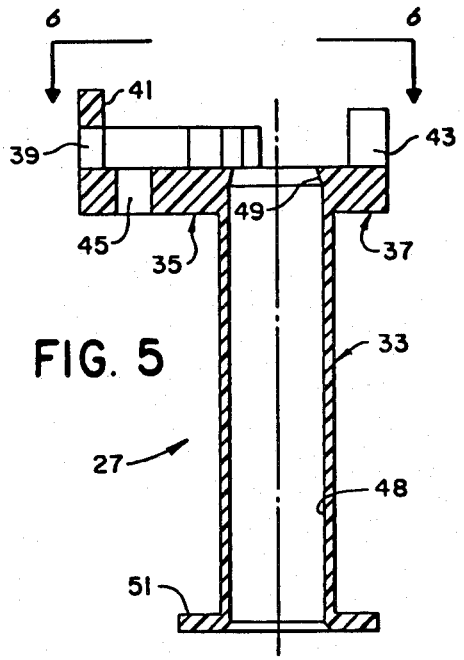
FIG. 5 is a cross-sectional view of the bobbin member of the coil assembly of the present invention.
Figure 6:
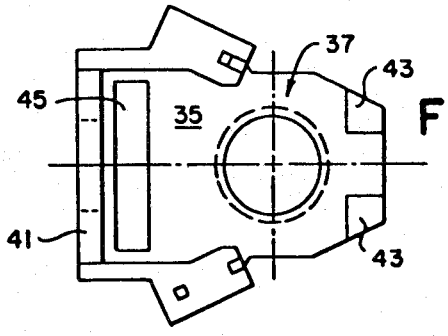
FIG. 6 is a top view of the bobbin member taken along line 6—6 of FIG. 5.
Figure 7:
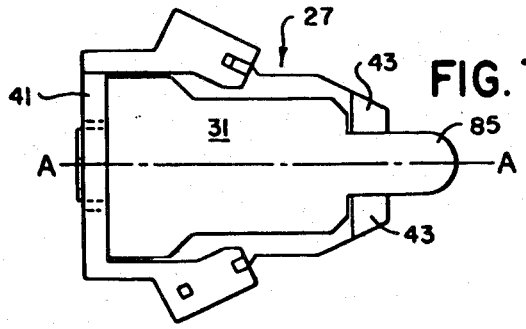
FIG. 7 is a top view of the coil assembly of the present invention taken along line 7—7 of FIG. 4 shown with the clapper member in its operating position on the bobbin member.

Coil assemblies 25 each include a bobbin member 27, coil member 29, and clapper member 31. As best seen in FIG. 4–7, the bobbin member of the coil assembly has first, second, and third portions. The first portion 33 has an open-ended, hollow shape dimensioned to slideably receive one of the pole pieces 19 therein. The second and third bobbin portions 35 and 37 are attached to an extend outwardly of a common end of the first portion 33 in substantially opposite directions as best seen in FIGS. 5 and 6. The second and third bobbin portions 35 and 37 include means for mounting the clapper member 31 therebetween for movement relative to the bobbin member. The clapper member mounting means includes the rear slot 39 in the upstanding member 41 of the second bobbin portion 35 and the slot between upstanding guide members 43 on the third bobbin portion 37. For clarity, guide members 43 are not shown in the perspective view of FIG. 1. The clapper member 31 is dimensioned to extend outwardly of the central axis A—A at the rear and middle of the clapper member 31 to engage respectively the members 41 and 43 whereby these members serve to restrain the clapper member 31 from movement along the central axis A—A relative to the bobbin member 27 as seen in FIG. 7. Slot 45 in the second bobbin portion 35 serves as an alignment slot to slideably receive the upstanding portion 17 of the yoke member as shown in FIG. 3 and 4. The members 41 and 43 of the second and third bobbin portion 35 and 37 also serve to restrict the movement of the clapper member 31 whereby the central axis A—A thereof remains in a predetermined plane relative to the bobbin member 27 with this predetermined plane intersecting the alignment slot 45. In operation, the central axis A—A of the clapper member 31 and the central axis of the first bobbin portion 33 remain substantially perpendicular. Also illustrated in FIG. 3–5 is the recess-detent retaining means 47 and 49 between the inner surface 48 of the first bobbin portion 33 and the outer surface 56 of the pole piece 19 (see FIGS. 4 and 5). In assembling the bobbin member 27 on the pole piece, the pole piece 19 is first slideably received in the first bobbin portion 33 until the recess-detent retaining means 47 and 49 mate as will be explained in more detail herebelow. Also in the assembly procedure, the coil member 29 is mounted about the first bobbin portion 33 and retained in place by the second and third bobbin portions 35 and 37 on one end and the lip member 51 on the other end.

Figure 8:
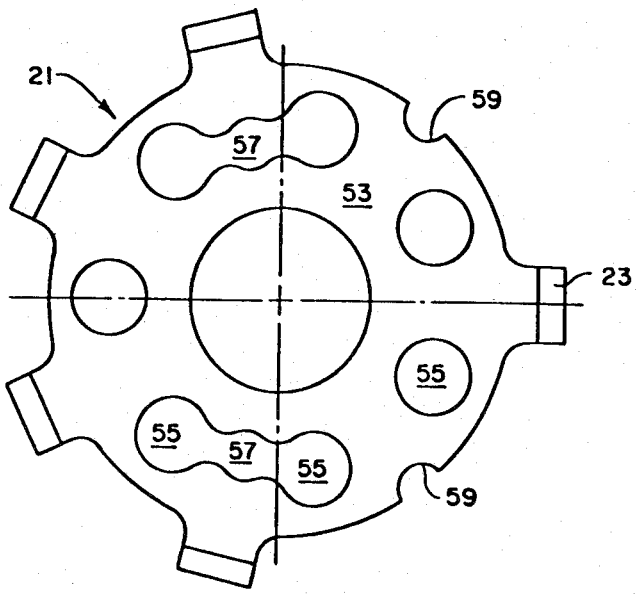
FIG. 8 is a view along line 8—8 of FIG. 4 showing a top view of the heat sink member of the present invention.
Figure 9:
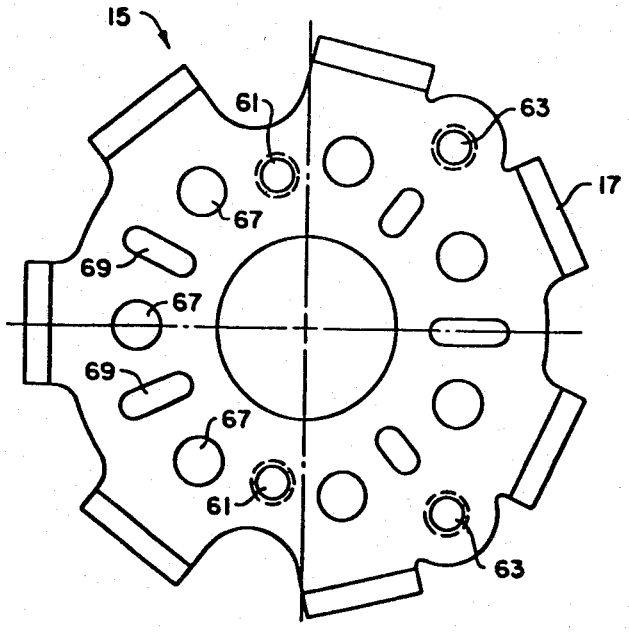
FIG. 9 is a view along line 9—9 of FIG. 4 showing a top view of the mounting plate of the present invention.

The heat sink member 21 and mounting plate 15 are best seen in FIGS. 1–4, 8, and 9. Heat sink member 21 in FIG. 8 has a planar portion 53 with alignment slots 55 therethrough dimensioned to slideably receive the pole pieces 19 as shown in FIGS. 3 and 4. Holes 57 and semi-circular holes 59 in FIGS. 8 are slightly larger than and designed to align with holes 61 and 63 in the mounting plate 15 of FIG. 9 to receive the heads of screws holding the mounting plate 15 to the wire guide assembly 13 and holding the rear guide rail, bearing support 65 to the mounting plate 15. Fingers 23 are integral with and extend upwardly from planar portion 53 of the heat sink member 21. Mounting plate 15 has holes 67 in FIG. 9 for receiving the ends of pole pieces and retaining them with the axes of the pole pieces substantially parallel to the axis of the wire guide assembly 13 in FIG. 3. Holes 69 in the mounting plate 15 are present to reduce cross-talk between the coil assemblies 25.

In assembling the print head 1 as best seen in FIGS. 3 and 4, the mounting plate 15 is first slid over the top portion 69 of the plastic, wire guide assembly 13 until it abuts the ledge 71 as shown in FIG. 3. The mounting plate 15 is then fixedly secured to the wire guide assembly 13 by screws placed in holes 61 and extending between the mounting plate 15 and outwardly extending ears (not shown) of the wire guide assembly 13. Screws are then placed through holes 61 to secure the bearing support 65 to the mounting plate 15. The heat sink member 21 is then moved downwardly in FIG. 4 to receive the pole pieces 19 in the alignment slots 55 until the heat sink member 21 abuts the mounting plate 15. Coil assemblies 25 are then moved downwardly in FIG. 4 to slideably receive the pole pieces 19 in the first bobbin portions 33 and the yoke portions 17 in alignment slots 45 of the second bobbin portions 35 until the recess-detent retaining means 47 and 49 on the inner and outer surfaces 48 and 56 of the pole pieces 19 and first bobbin portions 33 mate. The first bobbin portion 33 is dimensioned so that the mating recess and detent 47 and 49 firmly holds the planar portion 53 of the heat sink member 21 between the lip member 51 and mounting plate 15 as shown in FIG. 3. When assembled, heat sink member 31 helps to transfer heat generated in the area of the pole pieces 19 and coil members 29 outwardly to the finger members 23. Also when assembled, the finger members 23 of the heat sink member 21 and the upstanding yoke portion 17 of the mounting plate 15 are interspersed to provide more surface area for heat loss and to substantially prevent access as by fingers, paper clips, and the like to the interior of the print head 1.

Of particular note in this assembly process is the interaction between the upstanding yoke portions or alignment members 17 and the alignment slots 45 in the second bobbin portions 35. Specifically, the alignment slots 45 are dimensioned to slideably receive the upstanding ends of the yoke portions 17 in a close fitting relationship. By receiving respective pole pieces 19 in the first bobbin portions 33 and the yoke portions 17 in the alignment slots 45 of the second bobbin portions 35, each coil assembly 25 is automatically aligned during assembly with the impact end 85 of the clapper member 31 in FIGS. 2 and 3 against the impact end 87 of one of the print wires 89. Further, as illustrated in FIG. 3, the free standing ends of the yoke portions 17 abut the clapper member 31 when the recess and detent 47 and 49 mate and serve respectively as fulcrums for the clapper members 31.

Figure 11:
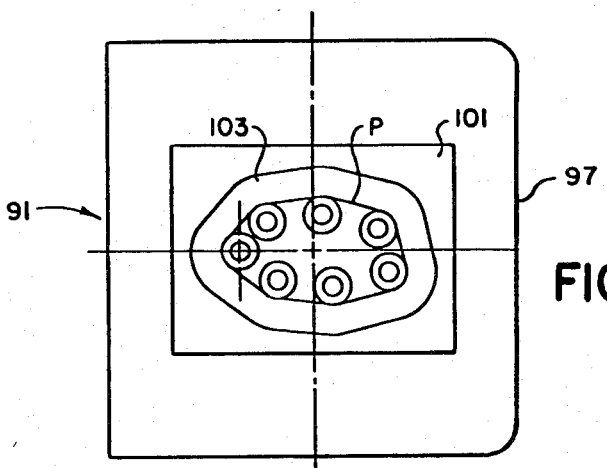
FIG. 11 is a top view of the rear wire guide member taken along line 11—11 of FIG. 10.
Figure 10:
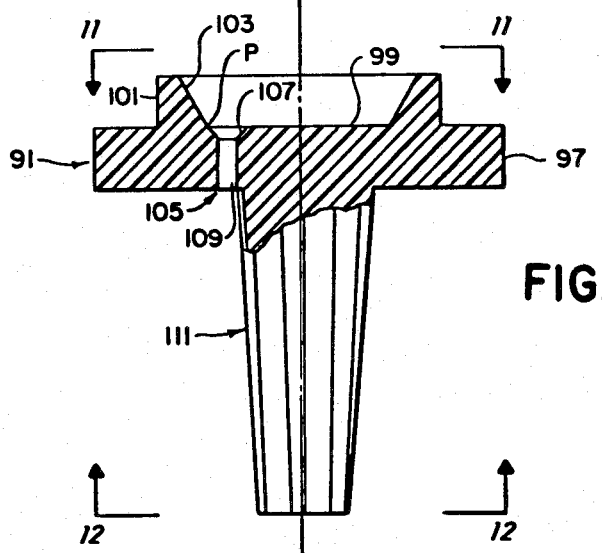
FIG. 10 is a partial cross-sectional view of the rear wire guide member of the present invention.
Figure 12:
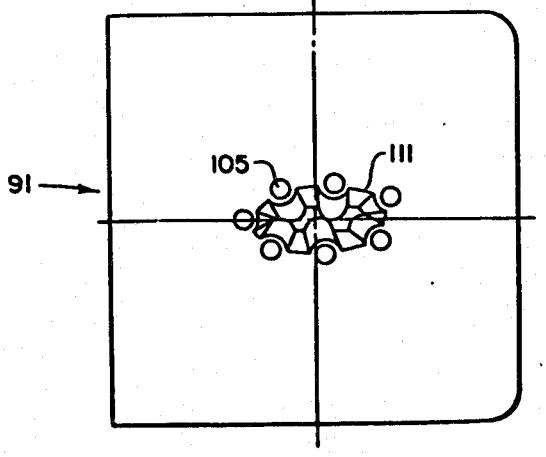
FIG. 12 is a bottom view of the rear wire guide taken along line 12—12 of FIG. 10.
Figure 14:
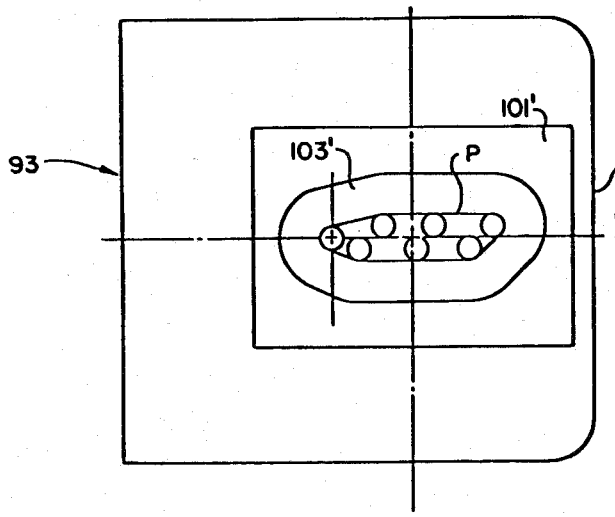
FIG. 14 is a top view of the middle wire guide member taken along line 14—14 of FIG. 13.
Figure 13:
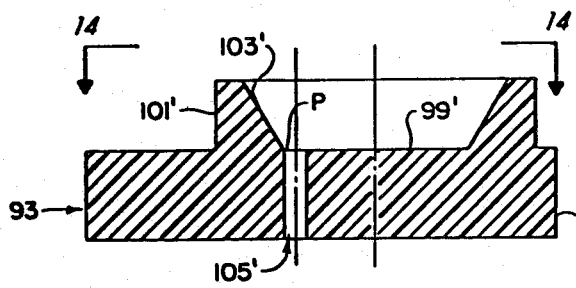
FIG. 13 is a cross-sectional view of the middle wire guide member of the present invention.
Figure 16:
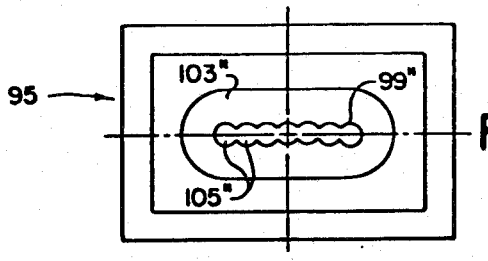
FIG. 16 is a top view of the front wire guide member taken along line 16—16 of FIG. 15.
Figure 15:
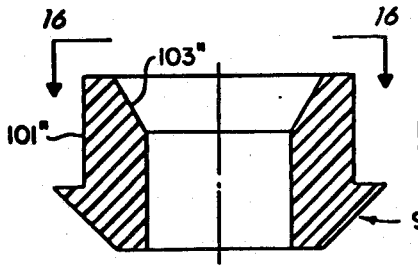
FIG. 15 is a cross-sectional view of the front wire guide member of the present invention.

FIGS. 10–17 illustrate the rear, middle, and front wire guide member 91, 93, and 95 for the print wires 89. Rear and middle wire guide members 91 and 93 in FIGS. 10 and 13 each have a main body 97 and 97' with a planar surface 99 and 99' and a rim portion 101 and 101' attached to and extending upwardly from the planar surface 97 and 97'. The rim portion 101 and 101' has a cam surface 103 and 103' extending upwardly from the planar surface 99 and 99' and outwardly of an axis perpendicular to the planar surface 99 and 99'. The cam surface 103 and 103' intersects the planar surface 99 and 99' at a plurality of points forming a closed path in P as best seen in FIGS. 11 and 14. The rear and middle wire guide members 91 and 93 also have a plurality of holes 105 and 105' through the main body portion 97 and 97'. Each of these holes 105 and 105' extends along an axis substantially parallel to the above-mentioned axis of the cam surface 103 and 103' and intersects the closed path P. In this manner, the print wires 89 can be advanced toward the respective wire guide members 91 and 93 to first contact the cam surface 103 and 103' of the rim portion 101 and 101' and then slideably moved there-along into one of the holes 105 and 105'. In the rear wire guide member 91 as shown in FIG. 10, the hole 105 is defined by first and second surfaces 107 and 109. The first surface 107 extends downwardly from the planar surface 103 and inwardly of the axis of the hole 105 to form a truncated cone shape. The second surface 109 is substantially cylindrical and extends downwardly from the first surface 107 about the axis of the hole 105. The front wire guide member 95 in FIGS. 15 and 16 also has a rim portion 101" with a cam surface 103" and a planar surface 99" which is much smaller than corresponding planar surfaces 99 and 99' because the holes 105" are aligned and interconnected as can be seen in FIG. 16.

Figure 17:
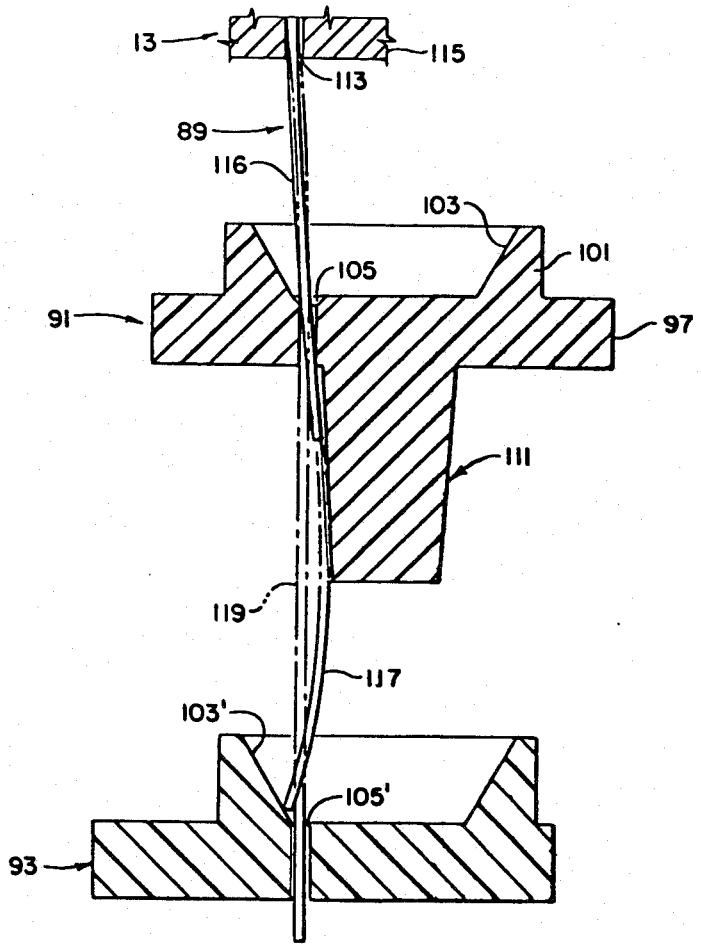
FIG. 17 is a cross-sectional view of the top rear, and middle wire guide members 115, 91, and 93 of the wire guide assembly illustrating the manner in which the grooved assembly aid attached to the rear wire guide member assists in the proper assembly of the print wires between the rear and middle wire guide members 91 and 93.

The grooved member 111 depending from the rear wire guide member 91 in FIG. 10 is an assembly aid for assisting the sequential insertion of the print wires 89 into the holes 105' of the middle wire guide member 93 as illustrated in FIG. 17. Referring to FIG. 17, the print wire 89 is first inserted through one of the holes 113 in the top wire guide member 115 shown in FIGS. 3, 4, and 17–19. The print wire 89 is then advanced along a substantially straight path (shown in solid lines in FIGS. 17) toward and through the hole 105 in the rear wire guide 91 until the leading end of the print wire 89 contacts the grooved assembly aid 111 in the bottom of a predetermined groove thereof. By continuing to advance the print wire 89, the assembly aid 111 serves to apply a force to the print wire 89 in a direction substantially perpendicular to the substantially straight path 116 mentioned above whereby the print wire 89 assumes a first bowed shape defining a path 117. Further advancing of the lead end of the print wire 89 along the first bowed shaped path 117 causes the lead end to contact the cam surface 103' of the middle wire guide member 93 where it is guided into the hole 105'. The cam surface 103' serves as a second assembly aid and when the print wire 89 is passed through the hole 105' in the middle wire guide member 93, the print wire 89 assumes a second bowed shape 119 which has less bow than the first bowed shape 117. In this manner, contact with the assembly aid 111 is eliminated and the print wire 89 only bears against the top, rear, and middle wire guide members 115, 91, and 93. This assembly technique using the assembly aids 111 and 103' reduces the assembly time necessary to insert the print wires 89 and eliminates the need for an assembler to physically grip and guide the print wires 89 through the holes 105' in the middle wire guide member 93.

Figure 18:
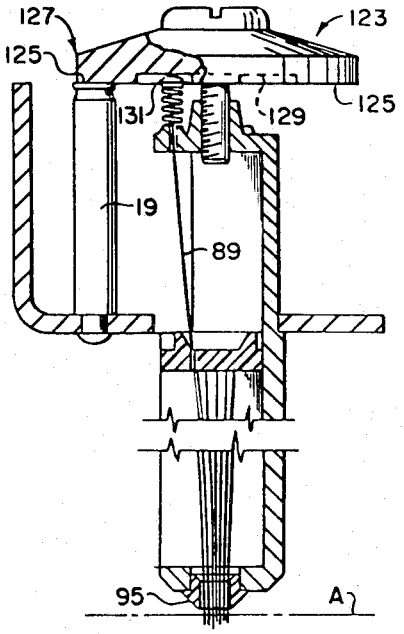
FIG. 18 is a partial, cross-sectional view of an assembly aid 111 and procedure whereby all of the print wires can be easily and quickly ground to the proper length.

FIG. 18 also illustrates an assembly technique for grinding all of the print ends of the print wires 89 so they lie in a common plane A in the impact area. In this assembly method, the cap 123 is screwed downwardly until the surface 125 of the rim portion 127 abuts the tops of the pole pieces 19. At this point, the inner, planar surface 129 of the cap 123 contacts all of the impact ends 131 of the print wires 89 and advances the print ends of the print wires 89 out of the front wire guide member 95 as illustrated in FIG. 18. The print ends are then ground off in a common plane which is perpendicular to the axis of the wire guide assembly 13 and parallel to the planar surface 129 of the cap 123. The distance between the rim surface 125 and the inner surface 129 of the cap 123 is exactly the thickness of the impact end 85 of the clapper member 31. Consequently, the cap 123 can be removed and replaced with restraining screw 65 and backstop 22 in FIGS. 3 and 19 whereby the restraining screw 4 is advanced until the surface 133 of the backstop 29 is exactly in the same place that inner surface 129 was in at the time of the grinding. In practice, this is accomplished by advancing the restraining screw 4 until it abuts surface 135 of the wire guide assembly 3 in FIG. 19 and then backing the restraining screw 4 off a predetermined number of turns.

Figure 19:
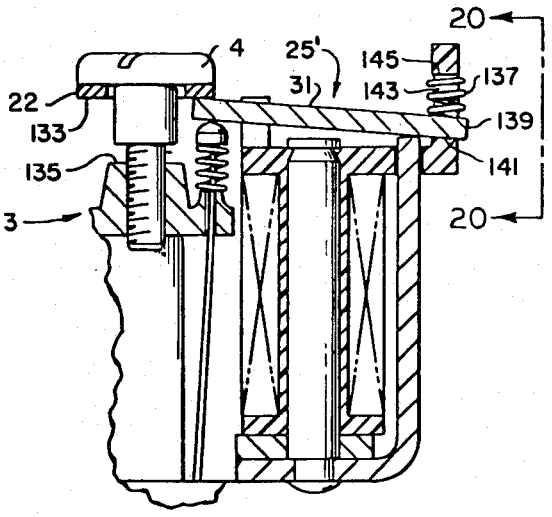
FIG. 19 is a cross-sectional view of a modified coil assembly design in which a return spring arrangement is mounted between the second bobbin member portion and the rear end of the clapper member.
Figure 20:
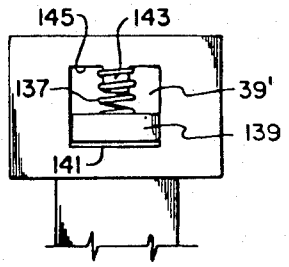
FIG. 20 is a view along line 20—20 of FIG. 19 showing a side view of the return spring arrangement for the clapper member.
Figure 23:
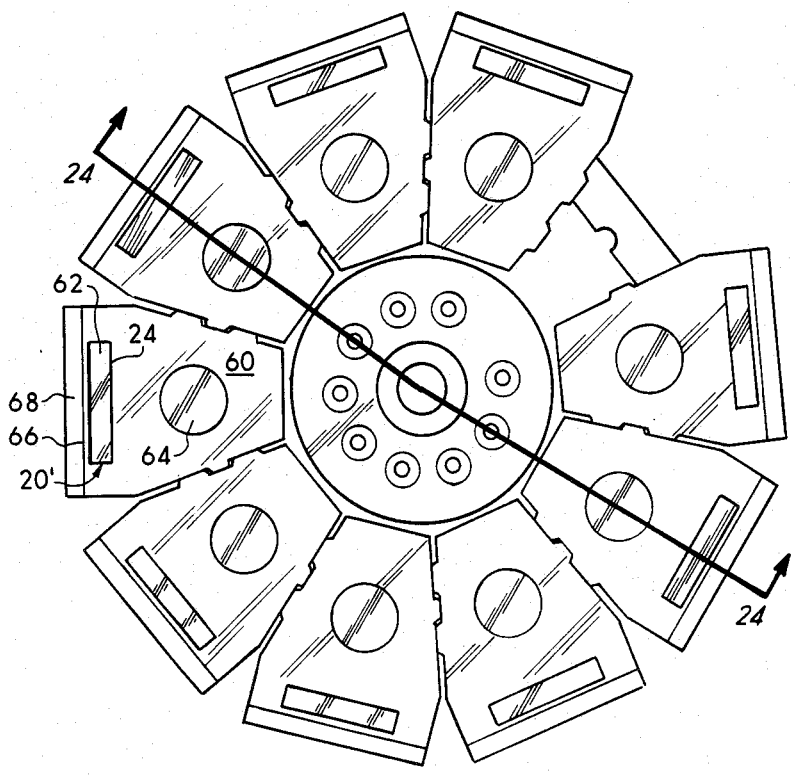
FIG. 23 is a top view showing the relationship of the coil assemblies, pole pieces, yoke members, wire guide assembly, and support member of the modified print head of FIG. 21.

FIGS. 19 and 20 illustrate views of a modified coil assembly 25' of the present invention. In the modified coil assembly 25, a return spring 137 is provided for biasing the rear end portion 139 of the clapper member 31 toward the bottom side 141 of the slot 39'. As seen in FIGS. 19 and 20, a post member 143 is attached to and extends downwardly from the top side 145 of the slot 39'. The free end of the post member 143 extends toward the bottom side 141 of the slot 39' for about half the distance between the top and bottom sides 145 and 141. The coil spring 137 is positioned about the post member 143 between the top side 145 and the rear portion 139 of the clapper member 31 as illustrated in FIGS. 19 and 20. The coil spring 137 serves to bias the rear end portion 139 of the clapper member 31 toward the bottom side 141 of the slot 39 and away from the top side 45 and post member 143.

Further designs of the present invention for simplifying and reducing the time needed for assembly and disassembly include the clamp means 147 for removably mounting the print head 1 to the main guide bearing 149 in FIGS. 1 and 3 and the snap arrangement 151 for mounting the print head 1 to the bearing 53 which rides on the rear guide rail 5. In assembly, the print head 1 is clamped to the main guide bearing 149 by placing the main guide bearing 149 between clamp portion 155 on the print head 1 and clamp portion 157 on the lower end of the support member 65 to the mounting plate 15 as discussed above are then tightened so that the print head 1 is firmly clamped to the main guide bearing 149. The head shaft 3 could already be positioned in the main guide bearing 149 prior to this clamping or it can be slid into the main guide baring 149 after the clamping procedure. The snap arrangement 151 by which the print head 1 is mounted to the bearing 153 includes the substantially U-shaped portion or member 161 on the top end of the support member 65 which has an inner surface substantially corresponding to the shape of the outer surface of the guide bearing 153. The guide bearing 153 has a resilient detent member 165 forming part of the outer surface. The inner surface of the U-shaped portion 161 has a mating recess portion 167 whereby the bearing 153 can be snapped into place and held against the U-shaped portion 161 of the support member 65 and then the rear guide rail 5 inserted in the bearing 153 and in another procedure, the bearing 153 can be mounted on the rear guide rail 5 and then the U-shaped portion 161 snapped thereon.

In the print head 2 of FIGS. 21–32, a modified and preferred design is illustrated. As best seen in FIG. 22 and like the other coil assemblies disclosed herein, the coil assembly of the modified print head 2 includes a bobbin member 6, coil member 8, and clapper member 10 with the coil member 8 being positioned about the first section 12 of the bobbin member 6. Further, like the designs of FIGS. 1–20, the print head 2 has a central axis A—A and includes a wire guide assembly 14, support member 16 whose central axis is coincident with A—A, pole pieces 18, and yoke members 20. The respective pole pieces 18 extend along respective axes B—B and are mounted to the support member 16 about the central axis A—A of the print head 2 in a predetermined relationship. In this relationship, the axes B—B of the pole pieces 18 are spaced from and substantially parallel to the central axis A—A. Similarly, like the designs of FIGS. 1-20, the yoke members 20 are attached to the support member 16 and are mounted about the central axis A—A in a predetermined relationship thereto and to the pole pieces 18. Each yoke member 20 as seen in FIG. 22 has a upstanding portion 20' extending along a respective axis C—C. The axes C—C are spaced from and substantially parallel to the central axis A—A of the print head 2 and the axes B—B of the pole pieces 18. Further similarities to the designs of FIGS. 1-20 also include the provision of an alignment slot 24 (see FIGS. 23 and 24) like slot 45 in FIGS. 4-6 to receive the end of the upstanding portion 20' of the respective yoke members 20. In this manner, the coil assembly 6 is then automatically aligned relative to the central axis A—A of the print head 2 when the respective pole piece 18 is received in the first section 12 of the bobbin member 6 and the yoke portion 20' is received in the alignment slot 24.

Unlike the designs of FIGS. 1-20, the preferred embodiment of FIGS. 21-32 mounts the clapper members 10 for movement relative to the respective pole pieces 18 using an arrangement of cover member 26 and securing cap member 28. More specifically, the cover member 26 has indentations 30 (see FIGS. 26 and 28) corresponding to the shape of each clapper member 10. In this manner, the tail 32 (see FIGS. 28) of the clapper member 10 is received between portions 34 of the cover member 26 beneath the outer O-ring 40 (see FIG. 31); and, the head 36 of each clapper member 10 (see FIG. 28) is positioned between two finger members 38 of the cover member 26. Additionally, the inner O-ring 42 which serves as the backstop member for the clapper members 10 preferably has a square cross section and is retained in the cover member 26 (see FIGS. 26, 29, and 32) by and between the pair of members 44 and 46. Each pair of members 44 and 46 is attached to and extends away from a respective finger member 38 along axes substantially parallel to the central axis 52 of the cover member 26. The members 44 and 46 in each pair are spaced from each other relative to the central axis 52 of the cover member 26 a distance at least as great as the thickness of the annular O-ring 42 (i.e., the distance between the inner and outer diameters of the O-ring 42). As shown, the members 38, 44, and 46 retain the O-ring 42 in the cover member 26 with the O-ring 42 extending about and uniformly spaced from the central axis 52 of the cover member 26.

Figure 26:
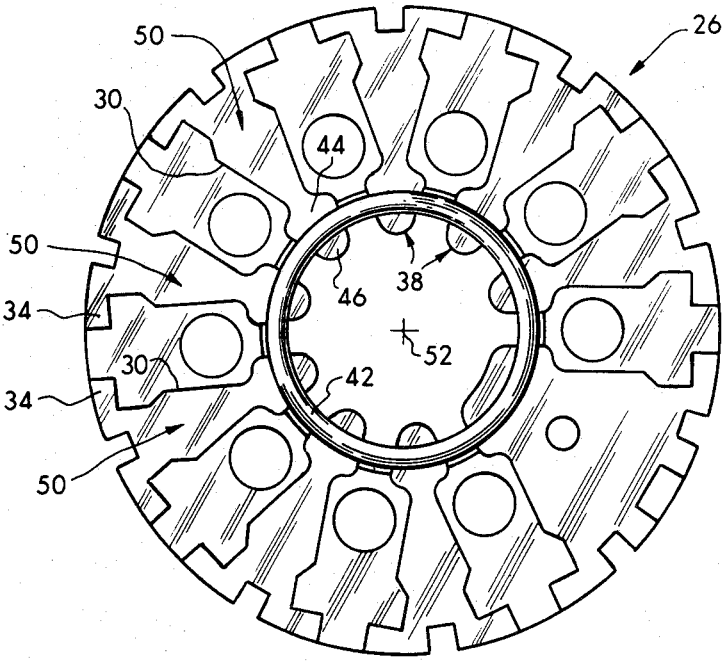
FIG. 26 is a bottom view of the cover member and backstop member.
Figure 31:
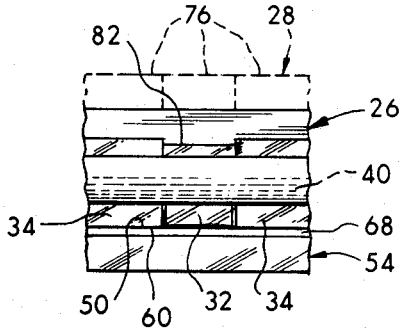
FIG. 31 is a view taken along line 31—31 of FIG. 28 with additional members of the print head shown in dotted lines for clarity.
Figure 32:
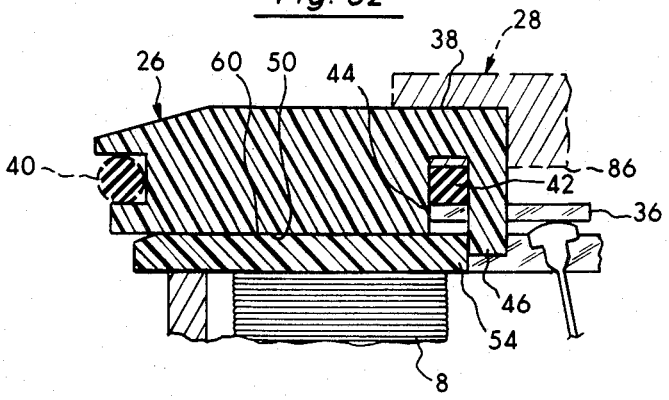
FIG. 32 is a view taken along line 32—32 of FIG. 28 with additional members of the print head shown in dotted lines for clarity.

As perhaps best seen in FIGS. 26, 31, and 32, the cover member 26 has planar surfaces 50 extending between indentions 30 (see FIG. 26). These surfaces 50 also extend outwardly of and about the central axis 52 of the cover member 26. The planar surfaces 50 are perpendicular to the central axis 52 of the cover member 26 and are coplanar with each other. In the assembled position of FIG. 22, the cap member 28 (as explained in more detail below) secures the cover member 26 against the second sections 54 of the bobbin members 6. In this position as best seen in FIG. 32, the planar surfaces 50 of the cover member 26 are pressed against portions of the planar surfaces 60 of the second sections 54 of the bobbin members 6. In this manner, the surfaces 50 and 60 are aligned parallel to each other and by geometry, the central axes 52 and A—A of the cover member 26 and print head 2 (which are perpendicular to the respective surfaces 50 and 60) are then aligned in a parallel fashion. The surfaces 50 and 60 can actually abut and press against one another directly if desired but in the preferred embodiment, the planar surfaces 50 of the cover member 26 are actually pressed against the planar surfaces 60 of the second bobbin sections 54 with the thin, non-magnetic member 58 of FIG. 27 sandwiched therebetween. In a known manner, the member 58 serves as a spacer so there is always a gap between the clapper member 10 and the top of the pole piece 18 even in the activated position of the clapper member 10 as shown on the right side in FIG. 22. The spacing member 58 has parallel, planar sides but even when used, it is so thin and pliable that for all practical purposes it offers no resistance to the planar surfaces 50 and 60 as they are pressed against and essential abut one another to align the central axes 52 and A—A of the cover member 26 and print head 2.

Figure 24:
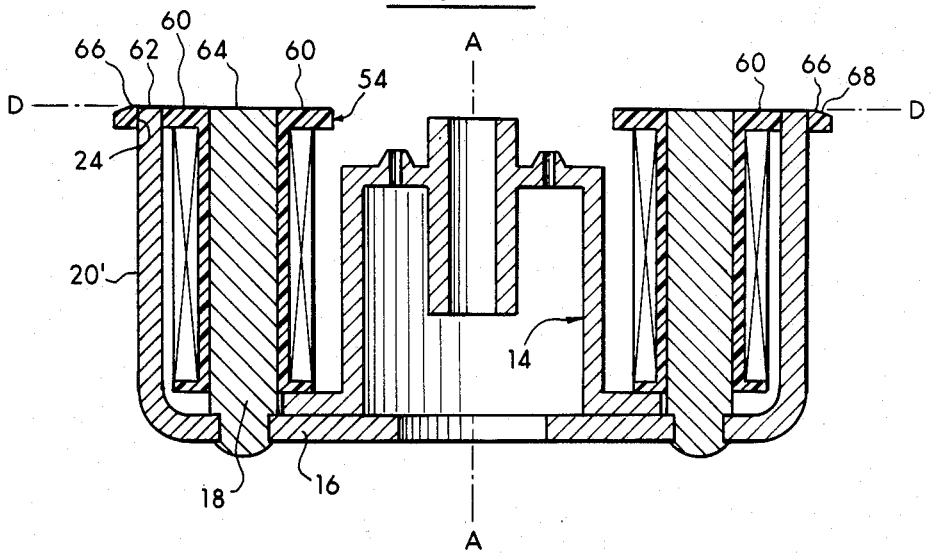
FIG. 24 is a view taken along line 24—24 of FIG. 23 illustrating the relationship of the members of FIG. 23 after the grinding step wherein the upper surfaces of the pole pieces, bobbin members, and yoke members are all coplanar and wherein these surfaces in each operating unit also form a continuous, planar surface.
Figure 25:
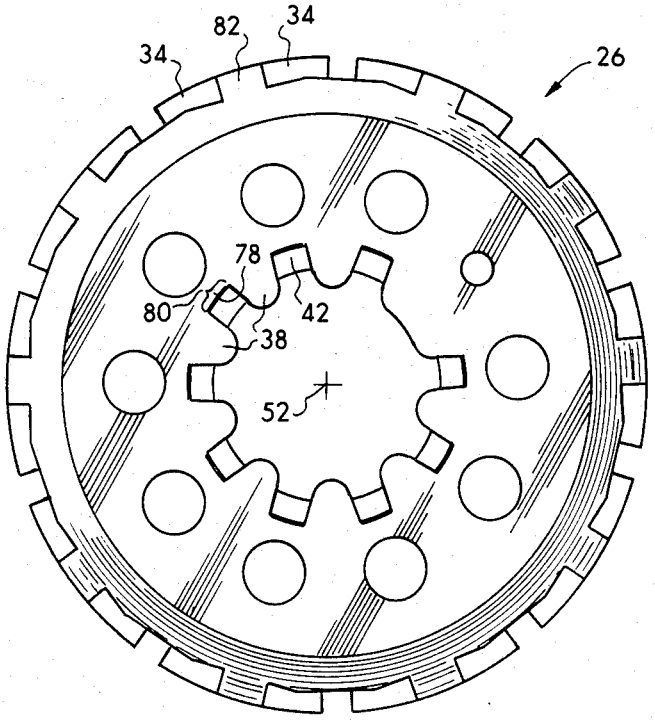
FIG. 25 is a top view of the cover member and the backstop member which is retained therein.

Referring to FIG. 24, the preferred embodiment of FIGS. 21 ∝ 32 unlike the designs of FIGS. 1-20 grinds the top of the free standing end portions of pole pieces 18, yoke members 20, and the second sections 54 of the bobbin members 6 along plane D—D. Plane D—D is perpendicular to the central axis A—A; and, in this manner, planar surfaces 60, 62, and 64 on the respective bobbin members 6, yoke portions 20', and pole pieces 18 are created which are perpendicular to the central axis A—A and coplanar with each other. The second bobbin section 54 corresponds to the second and third bobbin portions 35 and 37 of the embodiments of FIGS. 1-20 and the planar surface 60 of each section 54 surrounds and extends outwardly of the planar surface 64 of the respective pole piece 18 (see FIGS. 23 and 24). Additionally, the planar surface 60 surrounds and extends outwardly of the planar surface 62 of the yoke portion 20'. Further, as shown in FIG. 24, the planar surfaces 64, 62, and 60 of the pole pieces 18, yoke portions 20', and second bobbin sections 54 in each respective operating unit are aligned flush with each other and form a continuous, planar surface. This continuous, planar surface is aligned with plane D—D from edges 66 on the second bobbin sections 54 inwardly toward the central axis A—A (see FIGS. 23 and 24). The primary purpose of this feature is to create a uniform gap between each clapper member 10 and its respective pole piece 18 as explained in more detail below. In regard to the edge 66 which is positioned outside of the planar surface 62 of the yoke member 20 relative to the central axis A—A and is perpendicular to the axis A—A (see FIGS. 23 and 24), each edge 66 serves as the fulcrum or pivotal axis of the respective clapper member 10 as it pivots between its home or rest position as shown on the left in FIG. 22 to its activated or energized position as shown on the right in FIG. 22. As further shown in FIG. 24, each edge 66 is preferably formed by intersecting the planar surface 60 of the second bobbin section 54 with a second planar surface 68 at an angle to the plane D—D.

The cap member 28 as shown in FIG. 22 is secured by screw 70 to the wire guide assembly 14. In assembling the print head 2, the screw 70 moves the cap member 28 downwardly in FIG. 22 toward the cover member 26. If the cover member 26 is already against the second bobbin sections 54, this movement will continue until surfaces 72 on the portions 74 of the finger members 76 on the cap member 28 contact the corresponding surfaces 78 on the cover member 26. The surfaces 78 are on the connecting portions or bights 80 between the finger members 38 of the cover member 26 (see FIGS. 21 and 25). In this position with the surfaces 50 and 60 pressed against each other, the axes of the cover member 26 and print head 2 will then be aligned. If cover member 26 is not already abutting the second bobbin sections 54 as the cap member 26 is moved downwardly to the position of FIG. 22, the surfaces 72 of the cap member 28 will then contact the corresponding surfaces 78 on the connecting portions 80. Thereafter, continued rotation of the screw 70 will cause both the cap member 28 and the cover member 26 to move downwardly in FIG. 22 until planar surfaces 50 on the cover member 26 are pressed against the planar surfaces 60 of the second bobbin members 54 to align the axes 52 and A—A as explained above. In this position, the tail 32 of each clapper member 10 is received between the portions 34 of the cover member 26 beneath the outer O-ring 40 (see FIG. 22 and 31). The outer O-ring 40 as best seen in FIGS. 21 and 31 is retained in the cover member 26 by staggered lower portions 34 and upper pegs 82. The surfaces 72 and 78 are preferably planar and perpendicular to the respective axes of the cap member 28 and the cover member 26. Consequently, as the planar surfaces 50 and 60 press against each other to align the axes 52 and A—A, the relationship of surfaces 72 and 78 also causes the central axis of the cap member 28 to align with axes 52 and A—A.

The cap member 28 as it is moved toward the cover member 26 and secured in place also positions the backstop member 42 to define the second or rest position of the clapper members 10. More specifically and referring to FIGS. 21 and 25, the finger members 76 of the cap member 28 extend outwardly of the central axis of the cap member 28. Additionally, the finger members 76 are radially spaced from each other about the central axis of the cap member 28 in a manner corresponding to the spacing of the finger members 38 (see FIG. 25) of the cover member 26. Each finger member 76 has portions 74 and 84 (see FIG. 22) wherein the portions 84 of finger members 76 are received between two finger members 38 of the cover member 26 as the cap member 28 is moved to the position of FIG. 22. Portion 74 extends outwardly of portion 84 and each portion 84 has a lower surface 86 that is parallel to surface 72. The backstop member 42 is preferably placed initially at the top of the retaining means against the finger members 38 (see FIGS. 30 and 32) so that during assembly, the lower surfaces 86 contact the backstop member 42 and uniformly move it relative to the cover member 26. This contacting and moving of member 42 into the assembled relationship of FIG. 22 works against the biasing force of return springs 90 to determine the second or rest position of the clapper members 10 (i.e., the size of the gap between clapper members 10 and the top of the respective pole pieces 18). Further, this determination is done uniformly and sets automatically an identical gap for each clapper member 10 for precise operation of the print head 2. That is, the grinding step of FIG. 24 establishes a reference plane D—D and (by the geometry of planar surfaces 50, 60, 72, 78, and 86), the cover member 26, cap member 28, and backstop member 42 are aligned with each other and with the axis A—A and the gaps between each clapper member 10 and pole piece 18 are uniformly and automatically determined by simply rotating center screw 70 to the position of FIG. 22. Further, by modifying the distance 92 (see FIG. 22) between surfaces 72 and 86 as, for example, by grinding, providing a different cap member, or adding a spacer, the gaps can be easily and quickly modified. Additionally, the cover member 26 can be glued or otherwise held against the second bobbin sections 54. Thereafter, the screw 70 can be moved to a first position relative to the cover member 26 to establish a first gap and, if desired, then moved downwardly to uniformly move the O-ring 42 and simultaneously establish a second, smaller gap between each clapper member 10 and pole piece 18. In each case, the gaps set are identical and if the axis of symmetry of the O-ring 42 is not already aligned with axis 52 of the cover member prior to establishing the first relative position, it will be so aligned by the advancing of screw 70. Further, as the finger members 76 of the cap member 28 move the O-ring 42 relative to the cover member 26 to form a second, smaller gap, the finger members 76 do so uniformly and maintain the axes of the O-ring 42 and cover member 26 aligned during the process. In this manner, rotation of the screw 70 can be stopped at any point and the gaps are automatically set at the same distance.

Figure 30:
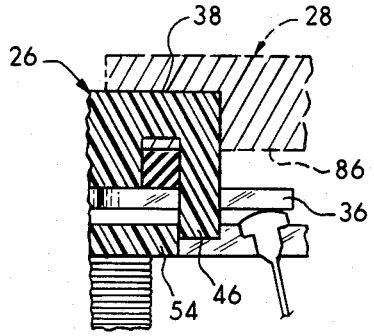
FIG. 30 is a view taken along line 30—30 of FIG. 28 with additional members of the print head shown in dotted lines for clarity.

By the geometry of the planar surfaces 50, 60, 72, 78, and 86 as discussed above, the axes of the print head 2, cover member 26, cap member 28, and O-ring 42 are aligned in parallel fashion. Further, by the additional action of the inner members 46 in each pair 44 and 46 of the retaining means for the O-ring 42, these axes are additionally aligned in a colinear manner. That is as best seen in FIGS. 30 and 32, the members 46 overlap and abut the second bobbin sections 54 and serve to center the cover member 26 and cap member 28 in the print head 2 with the respective axes thereof colinear.

While several embodiments of the present invention have been described in detail herein, it is understood that various changes and modifications can be made without departing from the scope of the invention.

We claim:

1. In a dot matrix print head having a central axis, a plurality of pole pieces extending along respective axes and mounted about said central axes, and a plurality of coil assemblies, each coil assembly including at least a clapper member and a coil member positioned about a respective pole piece, the improvement including:

means for mounting the clapper member of each respective coil assembly for movement relative to a respective pole piece between at least first and second positions, said mounting means including a cover member and an annular backstop member, said cover member having a central axis and means for retaining said backstop member in said cover member with said backstop member extending about the central axis of said cover member, said mounting means further including means for positioning said backstop member within said retaining means relative to the central axis of said cover member, said retaining means including a plurality of finger members radially spaced from each other about the central axis of said cover member, and said positioning means including a cap member having a central axis and a plurality of finger members extending substantially outwardly of and being radially spaced from each other about the central axis of said cap member, the respective radial spacing of the finger members of said cover member and said cap member about the respective central axes of said cover member and cap member substantially corresponding wherein said positioning means further includes means for securing said cap member in a first position relative to said cover member with the respective axes thereof substantially aligned and with at least first portions of each finger member of said cap member being received between portions of at least two finger members of said cover member and contacting said backstop member, and means for biasing each clapper member against said backstop member to define the respective second position thereof.

2. The improvement of claim 1 wherein said annular, backstop member has an inner and outer diameter with the difference therebetween representing the thickness of said backstop member and wherein said retaining means further includes a pair of members extending away from each finger member of the cover member along respective axes substantially parallel to the central axis of the cover member, one member in each pair being spaced outwardly of the other member relative to the central axis of the cover member a distance at least as great as the thickness of said backstop member wherein said annular, backstop member is received between each respective pair of members about the central axis of the cover member.

3. The improvement of claim 1 wherein each of the finger members of said cap member has a second portion extending outwardly of the first portion thereof relative to the central axis of said cap member, said second portion extending outwardly of said central axis of the cap member for a first distance, said cover member having connecting portions extending between the finger member of the cover member about the central axis thereof, said connecting portions extending toward the central axis of the cover member to a location spaced nearer the central axis of said cover member than said first distance, and said positioning means for said backstop member further includes means for moving said cap member relative to said cover member until the second portions of the finger member of said cap member abut said connecting portions to define the first position of said cap member relative to said cover member.

4. The improvement of claim 1 wherein each respective pole piece has an end portion and each respective clapper member is spaced from the end portion of the respective pole piece in said second position to define a gap therebetween and the improvement further includes means for moving said backstop member relative to said cover member to selectively adjust the size of said gap.

5. The improvement of claim 1 wherein said annular, backstop member is an O-ring.

6. The improvement of claim 5 wherein said O-ring has a substantially square cross section.

7. The improvement of claim 1 wherein each coil assembly further includes a bobbin member having first and second sections with said first section being positioned about a respective pole piece and said second section extending outwardly of said first section toward the central axes of said print head to a location spaced a first distance from said central axis and said retaining means for said backstop member includes a member extending away from each finger member of the cover member along a respective axis substantially parallel to the central axis of the print head, said members extending outwardly of said central axis of said print head to a location spaced a distance substantially equal to said first distance wherein said members of the retaining means abut respective second sections of the bobbin members and overlap the respective second section relative to the central axis of said print head to aid in positioning and maintaining said cover member in a predetermined relative position within said print head.

8. In a dot matrix print head having a central axis, a plurality of pole pieces extending along respective axes and mounted about said central axis in a predetermined relationship thereto with said pole axes spaced from and substantially parallel to said central axis, a plurality of yoke members mounted about said central axis in a predetermined relationship to said central axis and said pole pieces with at least a portion of each yoke member extending along a respective axis spaced from and substantially parallel to said central axis and the axes of said pole pieces, and a plurality of coil assemblies, each coil assembly being associated with a respective yoke member and a respective pole piece to form an operating unit therewith, each coil assembly including a bobbin member having at least first and second sections, said first section having an open-ended, hollow shaped to receive the respective pole piece therein, said coil member being positioned about said first portion, said second section of said bobbin member having a planar surface extending at least substantially between the respective pole piece and yoke member when said respective pole piece is received within said first section of the respective bobbin member, the improvement wherein:

each yoke member and pole piece of each respective operating unit has a free standing end portion with a planar surface extending perpendicular to said central axis, said planar surfaces of said yoke member and pole piece being coplanar with each other and with the planar surface of the second section of the bobbin member of the respective operating unit and wherein the planar surface of the second section of the bobbin member in the respective operating unit substantially surrounds the planar surface of the respective yoke member and extends outwardly of the planar surface of the respective yoke member relative to said central axis with the planar surfaces of the respective yoke members and second sections of the bobbin members being co-planar.

9. A method of making a dot matrix print head including the steps of:

(a) providing a support member having an axis, providing a plurality of yoke members attached to and extending away from said support member, and providing a plurality of pole pieces attached to and extending away from said support member, each of said yoke members and pole pieces having a free standing end portion, (b) providing a plurality of coil assemblies respectively having a bobbin member with a first section dimensioned to receive one of said pole pieces and having a coil member positioned thereabout, said bobbin member further having a second section with an end portion, (c) moving said coil assemblies relative to said pole pieces and yoke members with one of said pole pieces being respectively received in the first section of each coil assembly and with the end portion of said second section being adjacent the end portion of the respective pole pieces, (d) providing a planar surface on the end portion of each second section of the bobbin members and aligning the planar surfaces of the second sections in a common plane perpendicular to the axis of said support member, (e) providing a first member with a central axis and having planar surface perpendicular to said central axis, and providing an annular, backstop member and retaining said backstop member in said first member with said backstop member extending about the central axis of said first member, and (f) aligning the central axis of the first member parallel to the axis of the support member by substantially abutting portions of the planar surfaces of said first member against portions of the planar surfaces of the second sections of the bobbin members.

10. The method of claim 9 wherein said annular backstop member extends about an axis of symmetry and said method further includes the step of aligning said axis of symmetry parallel to the central axis of said first member.

11. The method of claim 10 wherein each coil assembly includes a clapper member and said method further includes the step of mounting the clapper member of each respective coil assembly for movement relative to a respective pole piece about a respective pivotal axis between first and second positions, each of said pivotal axes being in the common plane of step (d).

12. The method of claim 11 further including the step of moving said annular, backstop member relative to said first member while maintaining the axis of symmetry thereof parallel to the central axis of said first member.

13. The method of claim 10 further including the step of moving said annular, backstop member relative to said first member while maintaining the axis of symmetry thereof parallel to the central axis of said first member.

14. The method of claim 10 further including the step of moving said annular, backstop member relative to said first member to align the axis of symmetry of said backstop member parallel to the central axis of said first member.

15. A method of making a dot matrix print head including the steps of:

(a) providing a support member having an axis, providing a plurality of yoke members attached to and extending away from said support member, and providing a plurality of pole pieces attached to and extending away from of said support member, each of said yoke members and pole pieces having a free standing end portion, (b) providing a plurality of coil assemblies respectively having a bobbin member with a first section dimensioned to receive one of said pole pieces and having a coil member positioned thereabout, said bobbin member further having a second section with an end portion, (c) moving said coil assemblies relative to said pole pieces and yoke members with one of said pole pieces being respectively received in the first section of each coil assembly and with the end portion of said second section being adjacent the end portion of the respective pole piece, (d) grinding the end portions of said yoke members, pole pieces, and second sections of the bobbin members to form a planar surface on each end portion of said yoke members, pole pieces, and second sections with said planar surfaces being perpendicular to the axis of said support member and coplanar with each other, and (e) mounting the clapper member of each respective coil assembly for movement relative to a respective pole piece between at least first and second positions wherein said mounting step includes the substeps of:

(1) providing a cover member with a central axis and a plurality of finger members radially spaced from each other about the central axis, (2) providing an annular, backstop member and mounting said backstop member to said cover member about the central axis thereof, (3) providing a cap member with a central axis and a plurality of finger members extending outwardly of and being radially spaced from each other about the central axis of said cap member, (4) moving the cap member to a first position relative to said cover member with the respective central axes thereof aligned and with a least first portions of each finger member of said cap member received between portions of at least two finger members of said cover member and contacting said backstop member, and (5) biasing each clapper member against said backstop member to define the respective second portion thereof.

16. The method of claim 15 wherein each respective clapper member in said second position is spaced from the end portion of the respective pole piece to define a gap therebetween and the method further includes the step of moving said backstop member relative to said cover member to selectively adjust the size of said gap.

17. The method of claim 16 further including the limitation of uniformly moving said backstop member relative to said cover member and each pole piece wherein the gap between each clapper member and the respective pole piece is identical.

18. A method of making a dot matrix print head including the steps of:

(a) providing a support member having an axis, providing a plurality of yoke members attached to and extending away from said support member, and providing a plurality of pole pieces attached to and extending away from of said support member, each of said yoke members and pole pieces having a free standing end portion, (b) providing a plurality of coil assemblies respectively having a clapper member and a bobbin member with a first section dimensioned to receive one of said pole pieces and having a coil member positioned thereabout, said bobbin member further having a second section with an end portion, (c) moving said coil assemblies relative to said pole pieces and yoke members with one of said pole pieces being respectively received in the first section of each coil assembly and with the end portion of said second section being adjacent the end portion of the respective pole pieces, (d) grinding the end portions of said yoke member, pole pieces, and second sections of the bobbin members to form a planar surface on each end portion of said yoke member, pole pieces, and second sections with said planar surfaces being perpendicular to the axis of said support member and coplanar with each other, (e) forming a second planar surface on each respective second section with said second planar surface intersecting the first mentioned planar surface of said second section at an angle to form an edge, said edge being substantially perpendicular to the axis of the support member and being positioned outwardly of the planar surface of the respective yoke member relative to the axis of the support member, and (f) mounting the clapper member of each respective coil assembly for pivotal movement about each respective edge between first and second positions relative to each respective pole piece.

19. The method of claim 15 wherein each coil assembly includes a clapper member and said method further includes the step of mounting the clapper member of each respectively coil assembly for pivotal movement about an axis between first and second positions, each of said pivotal axes being in the common plane of step (d).

20. A method of making a dot matrix print head including the steps of:

(a) providing a support member having an axis, providing a plurality of yoke members attached to and extending away from said support member, and providing a plurality of pole pieces attached to and extending away from of said support member, each of said yoke members and pole pieces having a free standing end portion, (b) providing a plurality of coil assemblies respectively having a bobbin member with a first section dimensioned to receive one of said pole pieces and having a coil member positioned thereabout, said bobbin member further having a second section with an end portion, (c) moving said coil assemblies relative to said pole pieces and yoke members with one of said pole pieces being respectively received in the first section of each coil assembly and with the end portion of said second section being adjacent the end portion of the respective pole piece, (d) grinding the end portions of said yoke members, pole pieces, and second section of the bobbin members to form a planar surface on each end portion of said yoke members, pole pieces, and second sections with said planar surfaces being perpendicular to the axis of said support member and coplanar with each other, (e) providing a cover member having an axis and coplanar surfaces extending outwardly of and perpendicular to the axis of said cover member, and (f) aligning the axes of said cover member and said support member in a parallel relationship by moving said cover member toward the second sections of said bobbin members until at least portions of the planar surfaces of said cover member substantially abut at least portions of the planar surfaces of said second sections whereby the planar surfaces of said cover member and the planar surfaces of said second sections are parallel and the axes of said cover member and said support member are parallel.

21. In a dot matrix print head having a central axis, a plurality of pole pieces extending along respective axes and mounted about said central axis in a predetermined relationship thereto with said pole axes spaced from and substantially parallel to said central axis, a plurality of yoke members mounted about said central axis in a predetermined relationship to said central axis and said pole pieces with at least a portion of each yoke member extending along a respective axis spaced from and substantially parallel to said central axis and the axes of said pole pieces, and a plurality of coil assemblies, each coil assembly being associated with a respective yoke member and a respective pole piece to form an operating unit therewith, each coil assembly including a bobbin member having at least first and second sections, said first section having an open-ended, hollow shape to receive the respective pole piece therein, said coil member being positioned about said first portion, said second section of said bobbin member having a planar surface extending at least substantially between the respective pole piece and yoke member when said respective pole piece is received within said first section of the respective bobbin member, the improvement wherein:

each yoke member and pole piece of each respective operating unit has a free standing end portion with a planar surface extending perpendicular to said central axis, said planar surfaces of said yoke member and pole piece being coplanar with each other and with the planar surface of the second section of the bobbin member of the respective operating unit and wherein the second section of the bobbin member in each respective operating unit has a second planar surface intersecting the first mentioned planar surface of the second section at an angle and forming an edge, said edge substantially perpendicular to the central axis of said print head and being positioned outwardly of the planar surface of the respective yoke member relative to the central axis of said print head, and said print head further includes means for mounting the clapper member of each respective coil assembly for pivotal movement about each respective edge between first and second positions relative to each respective pole piece.

22. In a dot matrix print head having a central axis, a plurality of pole pieces extending along respective axes and mounted about said central axis in a predetermined relationship thereto with said pole axes spaced from and substantially parallel to said central axis, a plurality of yoke members mounted about said central axis in a predetermined relationship to said central axis and said pole pieces with at least a portion of each yoke member extending along a respective axis spaced from and substantially parallel to said central axis and the axes of said pole pieces, and a plurality of coil assemblies, each coil assembly being associated with a respective yoke member and a respective pole piece to form an operating unit therewith, each coil assembly including a bobbin member having at least first and second sections, said first section having an open-ended, hollow shape to receive the respective pole piece therein, said coil member being positioned about said first portion, said second section of said bobbin member having a planar surface extending at least substantially between the respective pole piece and yoke member when said respective pole piece is received within said first section of the respective bobbin member, the improvement wherein:

each yoke member and pole piece of each respective operating unit has a free standing end portion with a planar surface extending perpendicular to said central axis, said planar surfaces of said yoke member and pole piece being coplanar with each other and with the planar surface of the second section of the bobbin member of the respective operating unit and wherein the planar surfaces of the yoke member, pole piece, and second section of the bobbin member in each operating unit are coplanar with the corresponding planar surfaces in every other operating unit in the print head, and the improvement further includes means for mounting the clapper member of each respective coil assembly for movement relative to each respective pole piece, said mounting means including a cover member having a central axis and coplanar surfaces extending outwardly of and perpendicular to the central axis of said cover member, and means for aligning the central axes of said cover member and said print head in a parallel relationship, said aligning means including means for pressing at least portions of the planar surfaces of said cover member substantially against at least portions of the planar surfaces of said second sections of the bobbin members whereby the planar surfaces of said cover member and the planar surfaces of the second sections are parallel and the central axes of said cover member and print head are parallel.

23. The improvement of claim 22 further including means for aligning the central axes of said cover member and print head in a colinear relationship.

* * * * *